United States Patent [19]

Laufer

[11] Patent Number: 4,476,835

[45] Date of Patent: Oct. 16, 1984

[54] METHOD FOR DELAYING AXIAL MOVEMENT OF A PUMP PISTON IN A FUEL INJECTION PUMP FOR COMBUSTION ENGINES, AND FUEL INJECTION PUMP FOR COMPLETING THE PROCESS

[75] Inventor: Helmut Laufer, Stuttgart, Fed. Rep. of Germany

[73] Assignee: Robert Bosch GmbH, Stuttgart, Fed. Rep. of Germany

[21] Appl. No.: 415,954

[22] Filed: Sep. 8, 1982

[30] Foreign Application Priority Data

Nov. 7, 1981 [DE] Fed. Rep. of Germany ..... 3144277

[51] Int. Cl.[3] ..... F02M 57/02; F02M 59/34

[52] U.S. Cl. ..... 123/467; 123/503; 417/500

[58] Field of Search ..... 123/467, 503, 449, 495, 123/496; 417/500, 492

[56] References Cited

U.S. PATENT DOCUMENTS 4,211,203 7/1980 Kobayashi ..... 123/503

4,271,807 6/1981 Links ..... 123/467

*Primary Examiner*—Charles J. Myhre

*Assistant Examiner*—Carl Stuart Miller

*Attorney, Agent, or Firm*—Edwin E. Greigg

[57] ABSTRACT

A process for delaying the axial movement of the pump piston of a fuel injection pump of an internal combustion engine and fuel injection pump for completing the process are proposed. The fuel injection pump consists of a pump piston placed in a movable and rotating mode within a cylindrical bore of a cylindrical sleeve. The pump piston is designed as a combination piston with a damping piston of larger diameter, which will upon completion of the fuel injection period of the turn with the damping shoulder, border the damping chamber within damping bore of the cylindrical sleeve. This further allows only throttled amounts of fuel to flow through the throttling pintle into the suction chamber; the throttling pintle runs in a longitudinal direction and is located on the damping piston. This will produce supplementary hydraulic capacity extending from the damping shoulder, which has a supporting effect on the pump piston even at high turn speeds, and further allows for capacity increases of the fuel injection pump.

8 Claims, 6 Drawing Figures

METHOD FOR DELAYING AXIAL MOVEMENT OF A PUMP PISTON IN A FUEL INJECTION PUMP FOR COMBUSTION ENGINES, AND FUEL INJECTION PUMP FOR COMPLETING THE PROCESS

BACKGROUND OF THE INVENTION

The invention is based on a process and a fuel injection pump as defined hereinafter. Prior art of fuel injection pumps is known, wherein an increase in the conveying speed of the pump piston for capacity increases of a fuel injection pump failed because the essential spring powers necessary for a delay of the oscillating pump piston could no longer be realized.

OBJECT AND SUMMARY OF THE INVENTION

The process according to the invention and the fuel injection pump according to the invention demonstrate the definite advantage that a further increase in the speed of the pump piston, and thus a capacity increase of the fuel injection pump, can be achieved. In particular the invention provides a process for delaying the axial movement of a pump piston of a fuel injection pump for internal combustion engines, which in a cylindrical bore alternately provides a suction stroke and turn, and abuts the pump work chamber which during the injection period of the turn of the pump piston will provide for at least one fuel injection line with one fuel injection point, and following the injection period is capable of shutting off fuel flow to the suction chamber no later than completion of the injection period when the pump piston is made to bear a supplementary hydraulic pressure. The invention also provides an apparatus comprising a fuel injection pump for internal combustion engines with at least one pump piston performing alternating suction strokes and turns within a cylindrical bore. The encased pump work chamber during an injection period of a turn of the pump piston will at least provide for one injection line with a fuel injection source and an injection period of the turn, and subsequent cut-off of the fuel injection to the suction portion, particularly in executing the process described for delaying axial movement of the pump piston characterized by a fuel-filled damping chamber being provided whose volume during the turn of the pump piston can be reduced by the pump piston and which further provides for at least one throttling point in the direction of the suction portion and which comprises the only connection to the suction portion upon completion of the injection period of the turn.

The measures outlined in the dependent claims are more advantageous extensions or improvements of the process outlined in claim 1 and the fuel injection pump as outlined in claim 9. It is particularly advantageous to reduce the cross-sectional area of the throttling point during the turn of the pump piston. Advantageous further embodiments include the release of the damping element until the injection process of the turn has been completed.

DESCRIPTION OF THE EXEMPLIFIED EMBODIMENT

Figure 1:
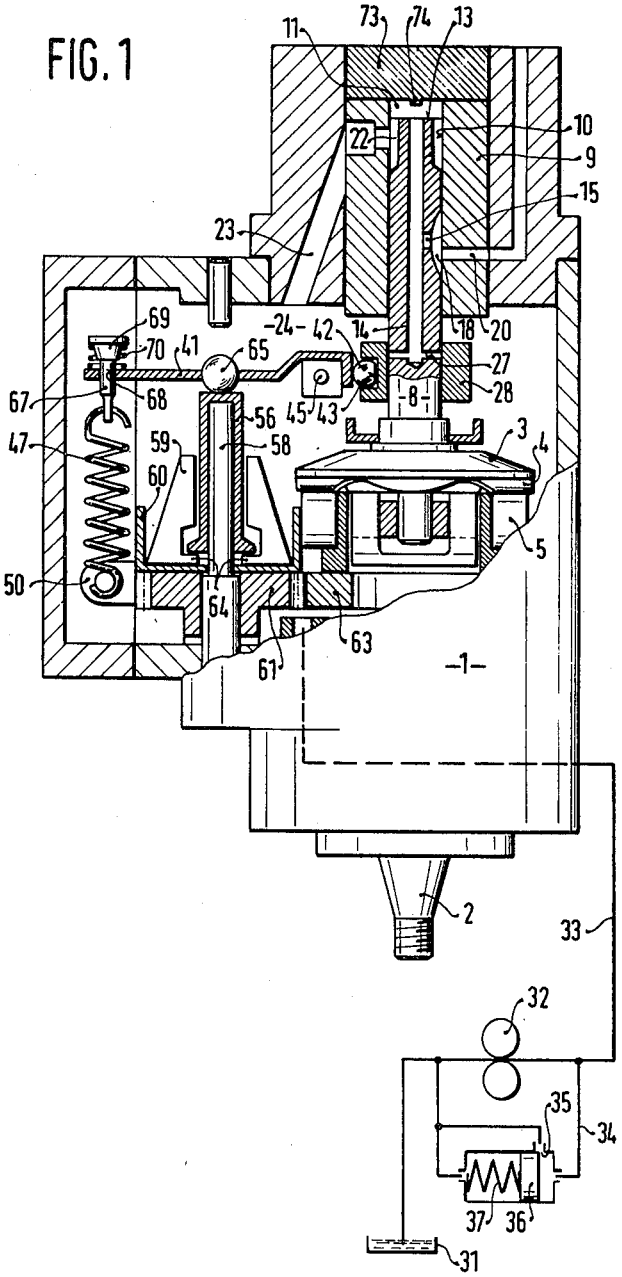
FIG. 1 is a partial cross-section showing a first exemplified embodiment of a fuel injection pump.

In a distributor pump of known design as seen in FIG. 1, a drive is supported in a housing 1 of a fuel injection pump for multi-cylinder internal combustion engines. The drive shaft is coupled with a face cam disc 3 which is provided with cams 4 in accordance with the number of cylinders of the combustion engine which are to be supplied with fuel. The cams are moved via stationary rollers 5 as a consequence of the rotation of the drive shaft 2. As a result, a pump piston 8 which is coupled with face cam disc 3 and pressed onto this disc by means of a spring (not shown) is set into simultaneously reciprocating and rotary movement.

This pump piston 8 operates within a cylinder sleeve 9 inserted into the housing 1 and closed at the top. The cylinder sleeve 9 has a cylinder bore 10 and there encloses a work chamber 11. From the frontal area 13 of the pump piston 8 adjacent to work chamber 11, an axial blind bore 14 is initiated in the pump piston. From the blind bore 14 an axial bore 15 leads to a distributor groove 18 on the circumference of the pump piston 8 in accordance with the rotational movement of the pump piston, communicating with blind bore 14, sequentially with individual pressure lines 20 discharging into the cylinder bore 10. The pressure lines 20 are distributed uniformly about the cylinder bore 10, corresponding in number to the number of engine cylinders of the combustion engine to be supplied, and lead to the injection valves (not shown) of the engine. Upon each compression stroke of the pump 8 the fuel is delivered via the blind bore 14, the axial bore 15 and the distributor groove 18 to one of the pressure lines 20. Upon the intake stroke, the fuel flows out of a suction chamber 24 via a supply line 23, which discharges into the cylinder bore 10, and one of the longitudinal grooves 22 existing on the jacket face of the pump piston into work chamber 11. Upon the compression stroke of the pump piston 8, communication between the supply line 23 and the longitudinal groove 22 is interrupted, so that the full quantity of fuel supplied by the pump piston can be delivered to the pressure lines 20.

In order to regulate the quantity of fuel supplied, the work chamber 11 can be made to communicate with the suction chamber 24 via an axial blind bore 14 in the pump piston 8 and a transverse bore 27 which intersects the blind bore. Cooperating with the transverse bore 27 is a fuel quantity adjusting member 28 in the form of a sleeve which can be displaced on the pump piston 8, and which by its position determines the instant at which the transverse bore 27 is opened during the upward movement of the pump piston 8 and at which communication is established between the work chamber 11 and the suction chamber 24. From this instant on, the pump supply is interrupted. The quantity of fuel proceeding to injection can thus be determined by adjusting this sleeve 28.

The supply of the suction chamber 24 with fuel is effected by means of a fuel pump 32, which aspirates fuel from a fuel container 31 and pumps it via feed conduit 33 into the suction chamber 24. In order to obtain a rpm-dependent pressure, a connecting line 34 having a throttle restriction 35 is disposed in the bypass around the fuel pump 32. The size of the throttle restriction is variable by means of a piston 36, which is subjected on its rear side to a spring 37 and to the intake-side fuel pressure ahead of the fuel pump and on its front side to the fuel pressure prevailing in the feed conduit 33.

In order to vary the fuel quantity, the sleeve 28 is adjusted by means of a governor lever 41, which with its ball head 42 engages a recess 43 of the sleeve 28. The governor lever 41 is supported as a fixed swivel point on a shaft 45. The position of this shaft can be varied by means not shown in further detail, for instance by an eccentric element, in order to attain a basic setting. The opposite end of the governor lever 41 is engaged by a governor spring 47. The other end of the governor spring 47 is secured to a correction leverl 50 which can adjust the rotation speed from the outside of housing 1.

The engagement point of a centrifugal governor sleeve 56, which is axially displaceable on a governor shaft 58 by means of flyweights, is located between the fastening point of the governor spring 47 and the shaft 45. The flyweights 59 are seated in pockets 60, which are firmly secured to a gear wheel 61, which is seated on the governor shaft 58. The gear wheel 61 is driven by means of a drive gear wheel 63 which is firmly connected to the drive shaft 2 and the flyweights 59 which are carried along by the gear wheel 61 via the pockets 60 are thereby moved radially outward in accordance with the rpm, with their nose-like elements 64 lifting the centrifugal governor sleeve 56. Upon the abutment of the centrifugal governor sleeve 56 on the governor lever 41, the rpm-dependent centrifugal force is thus transmitted by lever translation onto the governor lever 41, counter to the force of the governor spring 47. In order that the distance between the engagement point of the centrifugal force transmitted by the governor sleeve and the swivel point 45 will always remain the same, a ball 65 is pressed into the governor level 41 at this location, or a spherical end of the governor sleeve 56 presses against a flat face of the governor sleeve 41.

As soon as the right-hand-rotational moment attained by the means of the governor spring 47, the sleeve 28 is moved downward, in the direction of a reduction of fuel injection quantity. This continues until such time as a balance of forces again prevails at the governor lever 41.

Oriented toward the governor lever 41, one end of the governor spring 47 passes through a bolt 67, which passes through an opening 68 of the governor lever 41 and has a head 69 on its other end. A compression spring 70 is disposed between the head 69 and the governor lever 41. In FIG. 1, the rpm governor assumes the starting position, in which the compression spring 70 displaces the end of the governor lever 41 away from the head 69. The result of this action is that the sleeve 28 is displaced upward as far as possible, so that the distance which the pump piston 8 must travel before the transverse bore 27 is opened is relatively long, resulting in an increased fuel input, or starting quantity to the engine. Consequently, as soon as the idling rpm has been reached after starting, the compression spring (70) is compressed. When the idling rpm has been reached after start, the compression spring (70) will be compressed. When the idling rpm has been exceeded, the head 69 abuts governor lever 41.

The desired capacity increase of the fuel injection pump shall be attained by an increase of the turn speed in pump piston 8, whereby at the end of each turn an increased input for delaying the oscillating pump piston 8 and face cam disk 3 will have to be provided. The instant invention therefore intends additional hydraulic capacity to be produced no later than at the completion of the injection period of the turn, namely as soon as the transverse bores 27 are moved upward through sleeve 28, thus producing additional hydraulic power, which originating at the pump piston is opposing the pump piston movement. This increased power is accomplished by placing a throttle plug 74 extending into pump work chamber 11 and placed coaxially to the blind bore 14 at the pump work chamber 11 on the side of the boundary cover 73 averting the pump piston 8. The throttle plug 74 is somewhat smaller in diameter than blind bore 14 and long enough to insure submersion into blind bore 14 across the frontal area 13 of the pump piston 8 no later than at the completion of the injection period of the turn. Consequently, between the circumference of the throttle pintle 74 and the blind bore wall 14 a throttling point is developed, so that the fuel still retained in pump work chamber 11 can only flow through transverse bores 27 to suction chamber 24. The extent of the consequently originating additional hydraulic pressure on the pump piston can be influenced by the selection of the diameter of the blind bore 14, i.e. the diameter and length of throttle plug 74.

Figure 2:
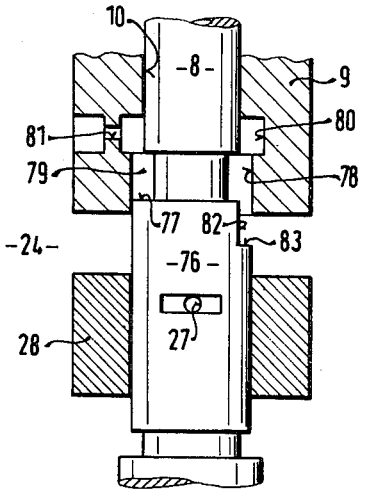
FIG. 2 a second, more developed partial cross-sectional view of a fuel injection pump.

The exemplified process as shown in FIG. 2 shows only a partial view of the fuel injection pump according to FIG. 1. There, the pump piston 8 is being supplemented by a damping piston 76 of larger diameter, which forms a damping shoulder 77. At the end directed toward sleeve 28 of the cylinder sleeve 9, a damping bore 78 is formed in the extension of cylinder bore 10, showing the same diameter as damping piston 76. As soon as the injection period of the turn has been completed, the damping piston 76 has meanwhile advanced so far toward damping bore 78, so as to block damping bore 78 with damping shoulder 77 in an axial direction, resulting in the formation of damping chamber 79 between pump piston circumference and the wall of damping bore 78. A connecting annular tee-slot 80 between cylindrical bore 10 and damping bore 78 is larger in diameter than damping bore 78 and is in constant contact with suction chamber 24 by means of throttle point 81.

Consequently, in an upward motion of the pump piston 8 during the remainder of the turn, the fuel retained in damping chamber 79 can only flow in a partially throttled manner through throttle point 81 to suction chamber 24, from the moment when damping shoulder 77 blocks damping chamber 79. The damping piston 76 shows a longitudinal groove terminating at the damping shoulder 77, so that a pressure increase in the damping chamber 79 is only possible after the averted end 83 of the longitudinal groove 82 is covered by the throttle or damping bore 78. The fuel enclosed by throttle piston 76 in the throttle chamber 79 consequently can only flow partially throttled through throttle point 81 during the remaining turn, which results in additional hydraulic pressure being exerted on damping shoulder 77; this action will also have an intercepting effect on the pump piston 8, even at maximum turn speeds.

Figure 3:
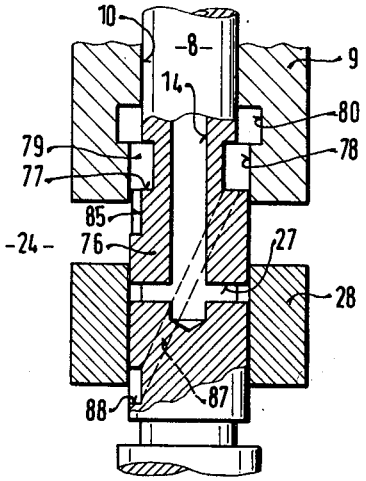
FIGS. 3, 4, 5 and 6 together show a third embodiment again in a cross-section partial view.
Figure 4:
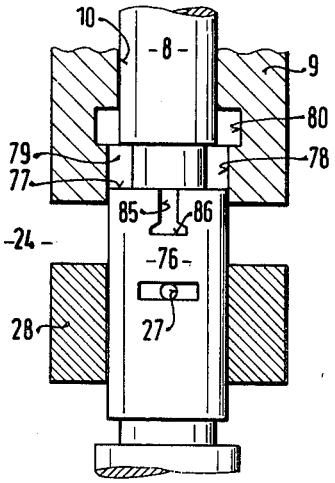

The exemplified process as shown in FIG. 3 and FIG. 4 of the partial view shows that the fuel injection pump according to the invention where compared to prior exemplified processes is marked identically and has synonymously operating parts. Thus, the instant exemplified process shows pump piston 8 also as a center piston with damping piston 76 of larger diameter, limited by a damping shoulder 77 on one, and damping chamber 79 in damping bore 78 in an axial direction on the other hand. Contrary to the exemplified process in accordance with FIG. 2 this does, however, not intend a throttle point in the wall of the cylindrical sleeve (9) in the direction of the damping chamber, but rather, the damping piston portion 76 shows as throttle point a throttle groove 85, which is open in the direction of the circumference of the throttle piston 76 and the throttle shoulder 77. As soon as throttle groove 85 is covered by the throttle bore 78 of the cylindrical sleeve during the turn of pump piston 8, which at the very latest will occur upon completion of the injection period, the fuel is locked into throttle chamber 79 and can only flow partially throttled through throttle groove 85 to the suction chamber 24. The speed of the pump piston 8 steadily decreases upon reaching a certain point of the turn, and thus also reduces the pressure at the throttling groove 85; to achieve the necessary hydraulic supplementary forces at the end of the turn the throttle diameter at the throttle groove, compared to the load changes, will decrease accordingly. For example, this change could be achieved by decreasing the depth of throttling groove 85, the further pump piston 8 approaches the top dead center at the end of the turn or, as seen in FIG. 4, the throttling groove 85 towards its end 86, could be designed so that to increase in width each turn will further decrease the throttled diameter.

Leading from damping chamber 79 a dotted line shows release line 87 which, for example, could run through damping piston 76, and, on the other hand, end in an outside groove 88 at the circumference of the damping piston 76. The outside groove 88 will be controlled by the fuel-metering device 28 so as to insure that damping chamber 79 is relieved during the injection period, whereas upon completion of the injection period of the turn the fuel-metering device or a sliding part controlled by said device will cover the outside groove 88, in order to prevent any flow from the damping chamber 79 through release line 87 to the suction chamber 24, and to further insure that in throttle chamber 79 pressure for developing the supplemental hydraulic capacity for pump piston 8 is made possible.

Figure 5:
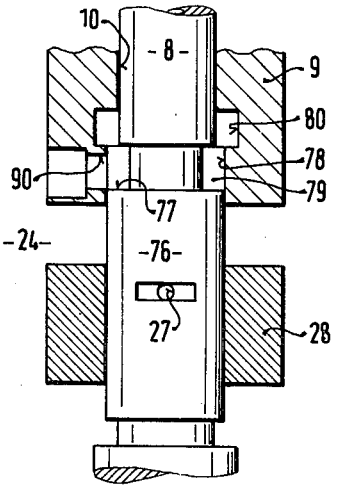

The exemplified process as soon in FIG. 5 of the invention differs from the beforementioned example in that the cylinder sleeve 9 in the direction of suction chamber 24 and damping chamber 79 shows a throttling point 90 in such a way that damping shoulder 77 of the damping piston 76 sweeps over the throttling point 90 during the turn of the pump piston but no later than the injection period; the fuel flow is then throttled from damping chamber 79 through throttling point 90 into suction chamber 24.

Figure 6:
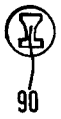

As shown in FIG. 6, the contour of the throttling point 90, based on the exemplified processes shown in FIG. 3 and FIG. 4, is such that at the end of each turn a stroke change occurs, resulting in the decrease of the throttling cross-section.

The defined exemplified processes thus allow higher turn speeds, which result in a capacity increase of the fuel injection pump by supporting the oscillating pump piston by means of the supplemental hydraulic pressure.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having at least one pump piston performing alternating suction strokes and turns within a cylindrical bore, a suction chamber, a pump work chamber and at least one injection line connectable to said pump work chamber during an injection period of the turn, said pump work chamber being connectable with said suction chamber for cut-off of the fuel injection and completion of the injection period during the turn of said piston pump, a fuel-filled damping chamber whose volume during a turn of said pump piston is reduced by the stroke of said pump piston, at least one throttling point positioned in a connection between said damping chamber and said suction chamber, whereby said connection is opened no later than upon completion of said injection period, and wherein said work chamber functions as said damping chamber facing an axial blind bore in said pump piston, a throttling pintle extending into said pump work chamber in a coaxial direction to said blind bore, whereby upon completion of the injection period of a turn of said pump piston said bore is opened at its end in the direction of said suction chamber and no later than upon completion of said injection period said bore surrounds said throttling pintle between whose circumference and said blind bore wall said throttling point is formed.

2. A fuel injection pump as defined by claim 1, wherein said pump piston comprises a damping piston section having a larger diameter than said piston and further having a damping shoulder which on one side abuts said damping chamber formed between the circumference of said pump piston and the wall of said cylindrical bore.

3. A fuel injection pump as defined by claim 2, wherein said throttle point is formed within the sleeve of said cylindrical bore.

4. A fuel injection pump as defined by claim 3, wherein said throttling point is controllable by means of a damping shoulder on said damping piston section.

5. A fuel injection pump as defined by claim 2, wherein said throttling point is formed in an axial direction along said damping piston section of said pump piston.

6. A fuel injection pump as defined by claims 4 and 5, wherein the cross-section of said throttle point decreases during a turn of said piston pump.

7. A fuel injection pump as defined by claim 2, wherein a release line for relieving said damping chamber leads from said chamber in the direction of said suction chamber up to the point of completion of the injection period of a turn, and a gliding fuel-metering device positioned on said pump piston for controlling said relief line.

8. A process for delaying the axial movement of a pump piston of a fuel injection pump for internal combustion engines arranged adjacent a pump work chamber and alternately providing suction strokes and turns comprising the steps of, connecting said pump work chamber with one of at least one fuel injection line leading to one fuel injection point during the injection period of a turn of said pump piston and connecting said pump work chamber for completion of the injection period with a suction chamber of the injection pump during the rest of said turn, producing a supplementary hydraulic pressure by fuel in a damping chamber, decreasing the volume of said damping chamber during the turn of said pump piston by said pump piston, whereby at least one throttling point connecting said damping chamber with said suction chamber is opened for allowing only reverse fuel flow from said damping chamber to said suction chamber no later than completion of said injection period, and subjecting said pump piston to said supplementary hydraulic pressure in opposition to the movement of said pump piston no later than completion of the injection period.

* * * * *